US005224269A

United States Patent [19]

Vale-Caban

[11] Patent Number: 5,224,269

[45] Date of Patent: Jul. 6, 1993

[54] INSTRUMENT FOR DRAWING DASHED LINES OR THE LIKE

[75] Inventor: Luis O. Vale-Caban, Aguadilla, P.R.

[73] Assignee: Commonwealth of Puerto Rico, San Juan, P.R.

[21] Appl. No.: 945,931

[22] Filed: Sep. 17, 1992

[51] Int. Cl.[5] ..... B43L 13/00

[52] U.S. Cl. ..... 33/39.1

[58] Field of Search ..... 33/39.1, 39.2, 32.1, 33/32.2, 32.3, 38, 41.1

[56] References Cited

U.S. PATENT DOCUMENTS

| | | | |
|---|---|---|---|
| 516,477 | 3/1894 | Dick | 33/32.2 |
| 519,155 | 5/1894 | Haug et al. | 33/39.1 |
| 852,430 | 5/1907 | Goodman | 33/32.2 X |
| 2,081,439 | 5/1937 | Simmons | 33/39.2 |

*Primary Examiner*—Harry N. Haroian

*Attorney, Agent, or Firm*—Oblon, Spivak, McClelland, Maier & Neustadt

[57] ABSTRACT

A drawing instrument for drawing straight or dashed lines including a scriber support assembly composed of a body part slidable in a groove on a ruler and an arm part which extends beyond either edge of the ruler and carries at its outer end a scriber. The inner end of the arm part is connected to the body part by a hinge and a follower carried by the arm part follows shapes such as undulations in grooves in the ruler between the side edge thereof and the hinge whereby the outer end of the arm part and the scriber are raised and lowered to make dashed lines. One groove can be flat whereby the scriber produces a continuous line.

9 Claims, 3 Drawing Sheets

INSTRUMENT FOR DRAWING DASHED LINES OR THE LIKE

FIELD OF THE INVENTION

This invention relates to drawing instruments and more particularly to instruments for drawing dashed or other type lines.

BACKGROUND OF THE INVENTION

Instruments for drawing dashed or similar lines e.g. dot-dashed or, alternatively, continuous lines are known. The patent to Simmons U.S. Pat. No. 2,081,439 teaches an instrument for drawing dashed lines wherein a horizontal carriage has fixed along one edge a downwardly extending fin which is slideably received in a longitudinally extending, open-topped groove in a ruler. The carriage extends beyond one longitudinal edge of the ruler and at its outer end it carries a vertically adjustable scriber such as a drawing pen. Intermediate the one longitudinal edge of the ruler and the slot is a follower which engages a longitudinally extending changeable plate having on its upper edge undulations defining peaks and valleys. As the carriage is moved longitudinally the follower follows the undulations and periodically lifts the scriber point from the paper being marked whereby a dashed line is drawn. The lengths of the dashes, that is, the parts of the line drawn by the scriber as the carriage is moved relative to the ruler, can be controlled by adjusting the scriber relative to the carriage so that the scriber pointer is closer to or farther away from the carriage. If it is lowered a substantial distance, the carriage and the follower are lifted relative to the ruler and the follower may just hit only the tops of the peaks whereby only short blank portions appear in the line between long dashes. If the point is lowered still more the follower is lifted entirely clear of the peaks and a continuous straight line is drawn.

In theory, the Simmons unit performs as intended. However, because its guide fin rides in an open top groove and is rigidly fastened to the carriage, as the follower traverses the peaks and valleys on the plate edges, the carriage must perforce rock which causes the fin to periodically cock in the groove thus impeding movement of the carriage, or the groove must be wide enough to cater to this problem thus producing a zigzag line, or the entire carriage and its fin must move vertically. It is difficult for an operator who is moving the carriage by a knob intermediate the groove and guide to control his manual vertical pressure on the knob so that the entire carriage can rise an fall and if he accidently lifts the carriage the pen can skip more than intended resulting in an uneven dashed line.

BRIEF DESCRIPTION OF THE INVENTION

The object of the present invention is to obviate problems inherent in a Simmons type drafting instrument by making the carriage in two parts: one, a body part which is manually slideable on the ruler while being positively prevented from being vertically movable relative to the ruler and an arm part which extends laterally beyond a longitudinal edge of the ruler and carries at its outer end a vertically adjustable scriber. The inner end of the arm part is connected to the body part by a hinge. A groove in the ruler between the hinge and the ruler edge carries means such as an undulating edge engageable by the lower end of a follower carried by the arm part which raises and lowers the outer end of the arm part and the scriber about the hinge to make dashed lines. As with Simmons, the vertical position of the scriber point can be adjusted upwardly or downwardly relative to the end of the arm part whereby the length of the dashes can be determined by the points on the peaks where they are engaged by the follower. Because this adjustment is not precise, the invention contemplates a plurality of parallel grooves having different patterns with means being provided for adjusting the follower along the arm part to engage the groove having the desired pattern.

Thus the object of the invention is to provide a drawing instrument for drawing dashed or straight lines wherein a scriber support comprises a manually movable body part slidable on a ruler and a scriber-carrying arm part connected to the body part by a hinge whereby the outer end of the arm part carrying the scriber can be vertically raised and lowered about the hinge entirely independently of the body part.

Another object of the invention is to provide a drawing instrument of the foregoing nature which may also carry at one end a protractor whereby lines drawn with the use of the instrument may extend at selected angles relative to a datum.

These and other objects will become apparent as the following detailed description is read in conjunction with the accompanying drawings wherein:

DETAILED DESCRIPTION OF THE DRAWINGS

Figure 3:
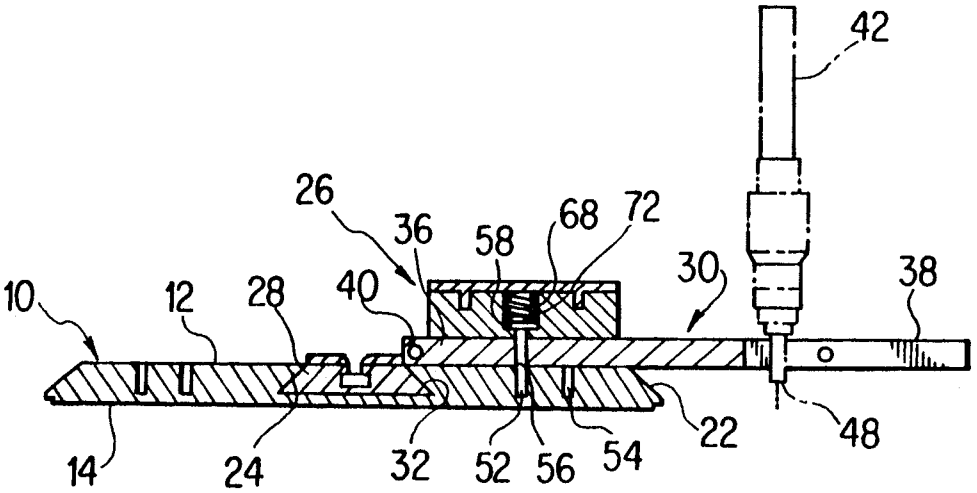
FIG. 3 is a vertical cross sectional view taken substantially on the line 3—3 of FIG. 1.

Referring now to the drawings the numeral 10 refers to a ruler having upper and lower faces 12, 14 encompassed by longitudinally spaced ends 16, 18 and laterally spaced side edges 20, 22. Guide track means such as the dovetailed slot 24, best seen in FIG. 3, is located on the upper face 12 of the ruler parallel to the side edges 20, 22. A scriber supporting assembly 26 movable on the ruler comprises a body part 28 and an arm part 30. The body part 28 has guide means, such as the dovetailed slide 32, slideably cooperating with the guide track 24, and manually engageable means, such as the knob 34 connected to the body part by a shaft 35 as shown in FIG. 1, is provided for moving the body part 28, and hence the entire scriber supporting assembly 26 along the guide track 24.

The arm part 30 of the scriber supporting assembly has inner and outer ends 36, 38 with a hinge 40, in accordance with the invention, pivotally connecting the inner end 36 of the arm part 30 to the body part 28 inwardly of the side edge 22 of the ruler. The outer end 38 of the arm part 30 extends laterally beyond the side edge 22 and carries scriber means, such as the pen 42 shown in FIGS. 1 and 3.

Figure 4:
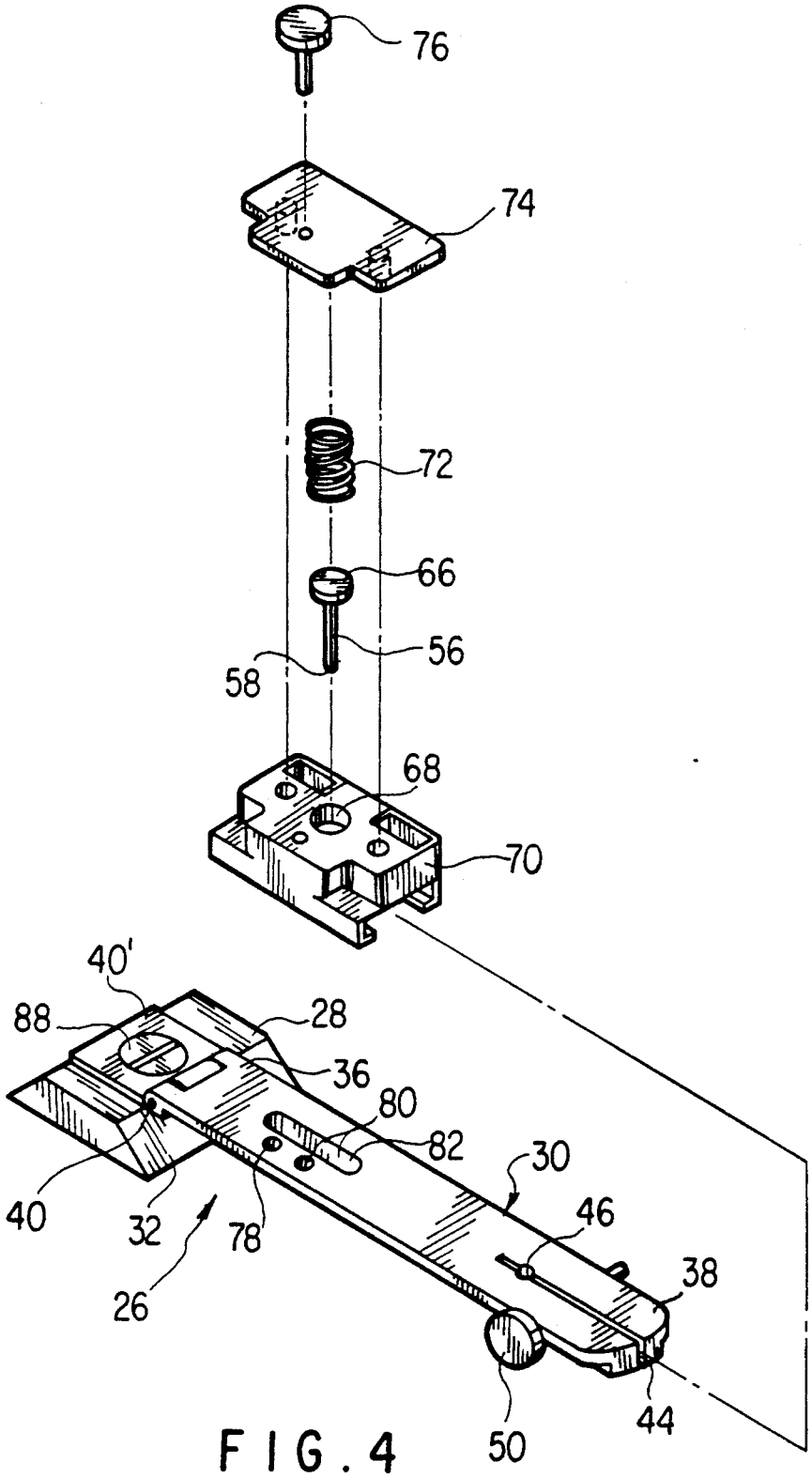
FIG. 4 is an enlarged exploded perspective view of the scriber support assembly.

As can be seen in FIG. 4, the outer end 38 of the arm part 30 is bifurcated at 44 and has an opening 46 through the bifurcation to receive a cylindrical barral part 48 (FIG. 3) of the pen 42. A thumb screw 50 may be screwed in or out to permit vertical adjustment of the pen barrel 48 in the opening 46 for purposes to be later described.

Figure 1:
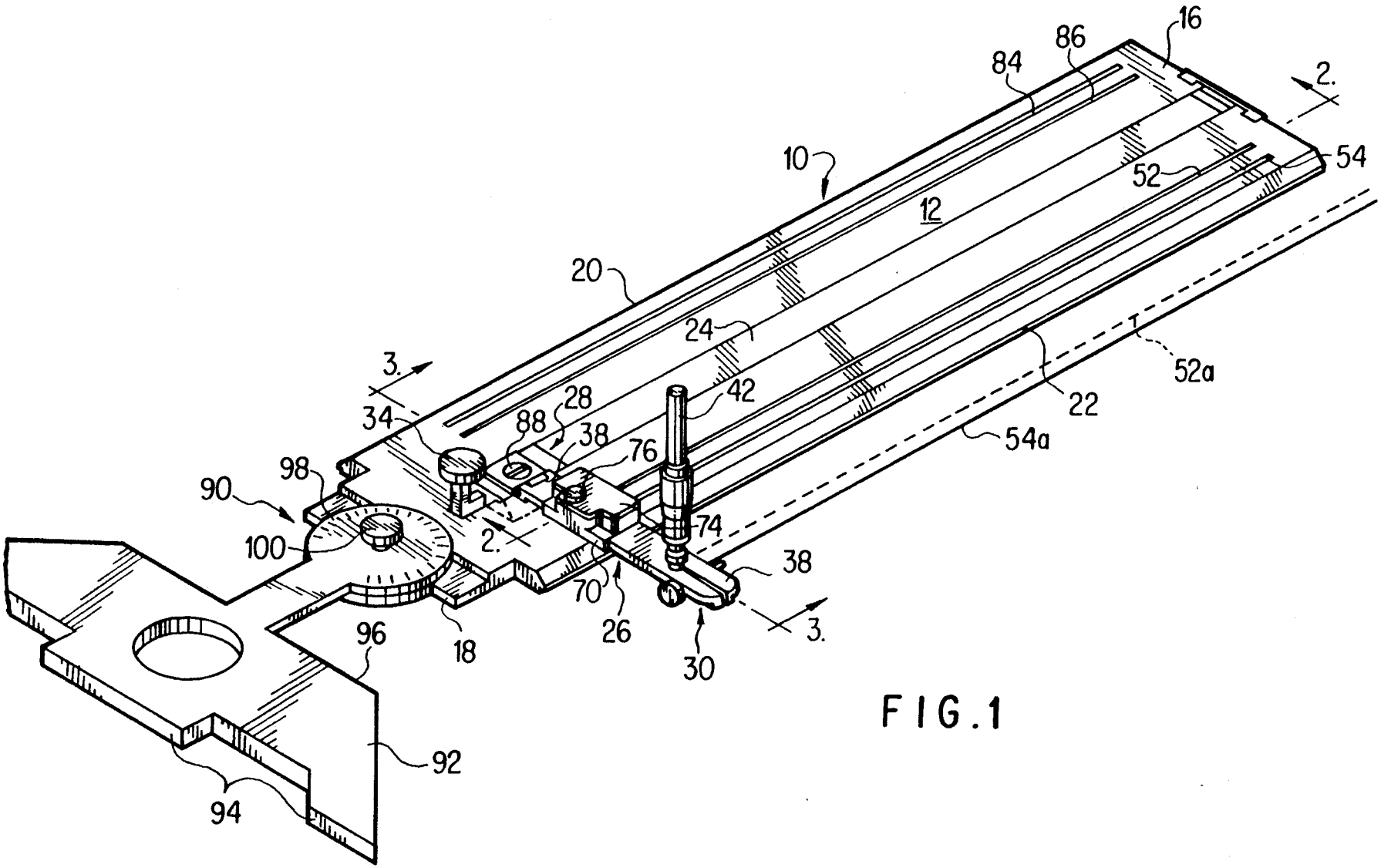
FIG. 1 is a perspective view of the drawing instrument incorporating the invention.

First longitudinally extending groove means, represented by the parallel grooves 52, 54, best seen in FIG. 1, are disposed on the upper face 12 of the ruler between the guide track 24 and the side edge 22 of the ruler. The grooves lie outwardly of the hinge 38 and underlie the arm part 30, as best seen in FIG. 3. A follower, represented by the needle 56 seen in FIGS. 3 and 4, is carried by the arm part 30 and is received in a selected groove, either 52 or 54, of the groove means, the needle 56 having a lower end 58 which is engageable with the bottom 60 of selected groove, say groove 52 as schematically shown in FIG. 2.

Figure 2:
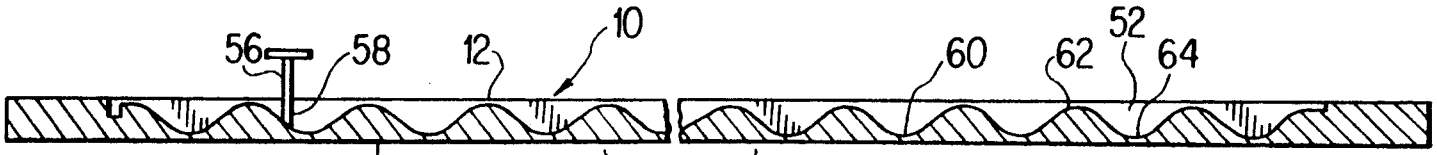
FIG. 2 is a vertical cross-sectional view taken substantially on the line 2—2 of FIG. 1.

At least one of the grooves, such as groove 52 has its bottom 60 undulating as shown in FIG. 2 to define peaks and valleys 62, 64 for effecting vertical movement of the follower needle 56 and hence the outer end of the arm part 30 and the scriber pen 42 about the hinge 40 as the body part 28 is moved along the guide 24 to draw a dashed line 52*a*. The bottom of each groove 52, 54 or as many additional grooves as there may be, has a shape differing from the bottom shape of any other groove, means being provided for laterally adjusting the position of the needle along the arm part 30 in any selected one of the grooves. The bottom of one of the grooves may be flat to enable the drawing of a continuous line 54*a*.

As shown the needle 56 has a head 66 which engages a stepped bore 68 (see FIG. 3) in a laterally movable slide member 70, best seen in FIG. 4. The needle head 66 is urged into engagement with the step of the bore by a spring 72 which is retained compressed by a cover member 74 retained over the spring by a thumb screw 76 which screws into one or the other threaded openings 78, 80 in the arm part 30 to enable the needle 56 to a properly positioned in a slot 82 in the arm part 30 to engage a selected groove 52 or 54.

Second groove means such as the grooves 84, 86 are provided on the upper face of the ruler between the other side edge 20 thereof and the guide track 24 which is located midway between the side edges of the ruler, means being provided to enable the arm part 30 and the hinge 40 to be changed from their position of FIGS. 1 and 3 to a position where the arm part extends identically beyond the other edge 20 of the ruler. The means enabling this change consists of a screw 88 which connects a leaf 40' of the hinge 40 to the top of the body part 28, the latter having a shallow recess therein to properly orient the hinge leaf 40' and hence the arm part 30 depending on which side of the ruler the arm part is desired to extend over.

In accordance with the invention, the instrument may include a protractor assembly 90. The assembly comprises a base member 92 having inner and outer parallel edges 94, 96 at least the inner edge being straight for abutting engagement with a guide edge, for example, a T-square. A protractor scale 98 is fixed to the outer edge 96 of the base member and a thumb screw 100 pivotally connects the end 18 of the ruler to the protractor 98, the thumb screw, upon tightening, releasably locking the ruler in any selected angular position relative to the protractor.

It will be noted, of course, that dove tail slide connection between the body part 28 and groove 24 positively prevents the body part and hence the arm part from being inadvertently lifted from the paper during a scribing operation. As a further precaution, the advancing knob 34 is connected only to the body part whereby manual force on the knob cannot be transferred to the arm part.

It is believed that us of the invention should be apparent from the foregoing description. It should be noted, however, that the vertical position of the pen 42 can be selectively adjusted to elevate or lower the arm part 30 and the follower needle 56 so that instead of closely following the valley floors it can be caused to move above the floor to strike the peaks part way up the slopes whereby the length of a dash line can be lengthened and the length of the spaces between the dashes shortened. It will also be apparent that the shapes in the grooves can be in replaceable racks having different edge configurations, including flat, to provide almost any type of dashed line, dashed-dot line or continuous line as may be desired.

It will be apparent that the invention is susceptible of a variety of changes and modifications, without, however, departing from the scope and spirit of the amended claims.

What is claimed is:

1. A drawing instrument comprising a ruler having upper and lower faces encompassed by longitudinally spaced ends and laterally spaced side edges, guide track means on said upper face of said ruler parallel to said side edges, a scriber support assembly comprising a body part and an arm part, said body part having guide means slideably cooperating with said guide track means and including manually engageable means for moving said body part along said guide track means, said arm part having inner and outer ends, a hinge pivotally connecting the inner end of said arm part to said body part inwardly of a side edge of said ruler, the outer end of said arm part extending laterally beyond said side edge, a scriber carried by the outer end of said arm part, first longitudinal groove means in the upper face of said ruler and disposed between said guide track means and said side edge outwardly of said hinge and underlying said arm part, and a follower carried by said arm part and received in said groove means, said follower having a lower end engageable with the bottom of said groove means.

2. The instrument of claim 1 wherein said first groove means includes at least one groove having an undulating bottom defining peak and valleys for effecting vertical movement of said follower and said outer end of said arm part and said scriber about said hinge as said body part is moved along said guide track means.

3. The instrument of claim 1 wherein said first groove means includes a plurality of parallel grooves the bottom of each of which has a shape differing from the bottom shape of any other groove, and means for laterally adjusting the position of said follower along said arm part for engagement in any selected one of said grooves.

4. The instrument of claim 1 including second groove means in the upper face of said ruler between its other side edge and said guide track means, said guide track means being located midway between said side edges and said first and second groove means, and means enabling said arm part and said hinge to be changed from a position wherein the arm part extends laterally beyond one edge of said ruler to a position wherein it extends laterally beyond the other edge of said ruler.

5. The instrument of claim 1 including a base member having inner and outer edges, at least the inner edge being straight for abutting engagement with a relatively fixed guide edge, a protractor scale fixed to the outer edge of said base member, means pivotally connecting one end of said ruler to said protractor, and means for releasably locking said ruler in any selected angular position relative to said protractor.

6. The instrument of claim 2 wherein said guide track means and said guide means include longitudinally extending overhanging means restraining substantially any vertical movement of said body part relative to said ruler as said body part is moved longitudinally relative to said ruler.

7. The instrument of claim 6 wherein said guide track means is a dove tail slot and said guide means is a slide having a dove tail shape complementary with said dove tail slot.

8. The instrument of claim 3 wherein the bottom of one of said grooves engaged by the lower end of said follower is flat along its entire length.

9. The instrument of claim 2 wherein said marker means includes a scriber point engageable with a substrate on which a line is to be drawn and means for adjusting vertically said scriber point relative to said arm thereby adjusting the vertical position of the lower end of said follower relative to the peaks and valleys of said undulations for controlling the degree of engagement of said follower with said peaks and therefore the length of dashes of a line drawn on said substrate as said body part is moved longitudinally of said ruler.

* * * * *